US005172779A

United States Patent [19]

Siracki et al.

[11] Patent Number: 5,172,779

[45] Date of Patent: Dec. 22, 1992

[54] RADIAL CREST INSERT

[75] Inventors: Michael A. Siracki, Spring; Gary R. Portwood, Katy; Chris E. Cawthorne, The Woodlands, all of Tex.; James C. Minikus, Costa Mesa, Calif.

[73] Assignee: Smith International, Inc., Houston, Tex.

[21] Appl. No.: 798,435

[22] Filed: Nov. 26, 1991

[51] Int. Cl.[5] ..... E21C 13/00

[52] U.S. Cl. ..... 175/420.1; 175/428

[58] Field of Search ..... 175/374, 420.1, 428, 175/431, 432, 435

[56] References Cited

U.S. PATENT DOCUMENTS

| | | | |
|---|---|---|---|
| 3,442,342 | 5/1969 | McElya et al. | 175/374 |
| 4,254,840 | 3/1981 | Shay, Jr. | 175/410 |
| 4,705,124 | 11/1987 | Abrahamson et al. | 175/420.1 X |
| 4,940,099 | 7/1990 | Deane et al. | 175/374 |

*Primary Examiner*—Thuy M. Bui

*Attorney, Agent, or Firm*—Robert M. Vargo

[57] ABSTRACT

A chisel insert for rolling cone rock bits is disclosed in which the crest of the insert has a "dog bone" shape by being rounded with the crest ends flaring out to a larger dimension than the middle thereof. The crest is also convex upwardly along its median line thereby making a shorter moment arm at the ends of the crest.

9 Claims, 2 Drawing Sheets

RADIAL CREST INSERT

BACKGROUND OF THE INVENTION

I. Field of the Invention

The present invention relates generally to chisel inserts for rolling cone rock bits and more particularly to specifically shaped inserts for use on the drive rows of the rolling cones.

II. Description of the Prior Art

Rock bits using sintered tungsten carbide inserts with cutting tips having a generally wedge or chisel-shaped configuration are used for drilling soft and medium formations. Various configurations for wedge-shaped inserts are shown in U.S. Pat. No. 3,442,342. Inserts of this type have a pair of symmetrical flanks that converge to a rounded crest. The inserts are interferingly secured in holes drilled normal to the cutter surface.

In operation, as the cutter or cone rotates, the crest initially contacts the formation at a time when the longitudinal axis of the insert is non-perpendicular with respect to the hole bottom. Bending stresses are thus generated in the inserts, tending to cause breakage.

This is particularly true in the drive row of the cutters, the first row of inserts inboard of the gage row. Drive row inserts experience more chippage and breaking initiating at the corners of the insert crest.

To alleviate this breakage problem, the nose radius has been made larger across the entire crest length. Although such blunter inserts have been successful in reducing breakage, they have also functioned to reduce the rate of penetration of the bit.

The inner row inserts of U.S. Pat. No. 3,442,342 had slightly convex crests and flanks which intersected to enable the crest to have a uniform width. The patent further states that if the flanks were flat, the natural intersection with the crest would create a crest of non-uniform width, thin at the middle and flaring out to a larger dimension at each end. Such a crest was considered to be undesirable because if the center dimension were large enough to avoid breakage, the ends would also be so wide that the tip would be dull at those locations, and conversely, if the ends were thinned down to a sharp width, the center part of the crest would be so fragile as to invite early breakage.

Another prior art insert is shown in U.S. Pat. No. 4,254,840. This insert includes a cutting tip made primarily of a truncated cone having a hemi-spherical tip mounted thereon. The sides of the sphere are tangential to the conical surface. A pair of flats are then placed into the sides of the cutting tip.

The problem with such an insert is that the radius of the cutting tip is constant and relatively large thereby functioning to reduce the rate of penetration.

SUMMARY OF THE INVENTION

In accordance with the present invention, a chisel insert is provided that goes against the teachings of the prior art by having a bone shaped crest formed thereon. The crest is rounded with the ends of the crest flaring out to a larger dimension than the middle thereof. This varying crest or nose radius allows the higher loaded areas on the outside corners of the crest to have the larger radii and larger mass to counteract this load.

In the preferred embodiment, the crest is also convex along its median line which makes the actual insert extension less at the crest corners thereby making a shorter moment arm in a location where impacts are more frequent.

In one embodiment of the present invention, the convex surfaces of the insert extension intersect with the crest so as not to have any non-tangential intersections.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
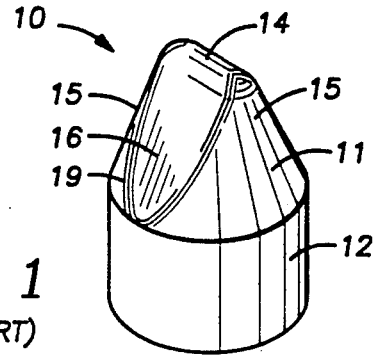
FIG. 1 (PRIOR ART)
FIG. 1 is a perspective view of a prior art conventional chisel crested insert.
Figure 2:
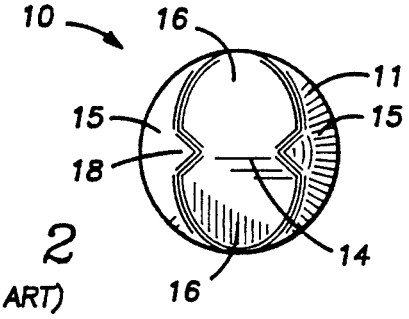
FIG. 2 (PRIOR ART)
FIG. 2 is a top elevational view of the prior art insert.
Figure 3:
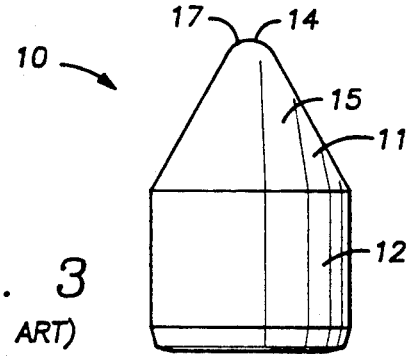
FIG. 3 (PRIOR ART)
FIG. 3 is a side elevational view of the prior art insert.
Figure 4:
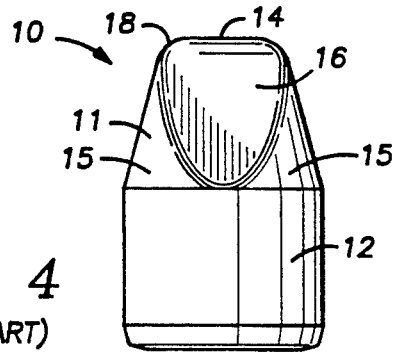
FIG. 4 (PRIOR ART)
FIG. 4 is a front elevational view of the prior art insert.

Referring now to the drawings, FIGS. 1 to 4 illustrate a conventional, prior art, chisel-shaped tungsten carbide insert 10 having a cutting tip portion 11 and an integral base portion 12, the latter being typically cylindrical and both parts being centered about an axis of the base.

The cutting tip 11 of insert 10 has its outermost extremity formed with a curvlinear crest 14. Cutting tip 11 also has a pair of flanks 16 generally converging toward crest 14. The balance of the cutting tip 11 is a conical surface 15.

The crest 14 is round in the direction along its median line and it is also rounded in the direction athwart its median line, as shown by the curves 17 and 18. The smaller curve 17 is tangent to flanks 16, while the curve 18 is tangent to the conical surface 15.

Flanks 16 can be flat or could also be rounded, being convex outwardly. In addition to the described curves and rounds, the intersections 19 of flanks 16 with the conical surface 15 are also preferably blended or rounded.

All of the above described curves and rounds are incorporated in the inserts prior to sintering in the pressing mold.

Figure 5:
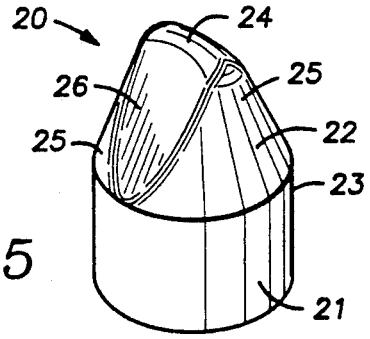
FIG. 5 is a perspective view of the first embodiment of a chisel crested insert made in accordance with the present invention.
Figure 6:
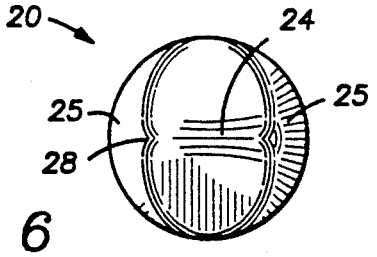
FIG. 6 is a top elevational view of the insert of the first embodiment.
Figure 7:
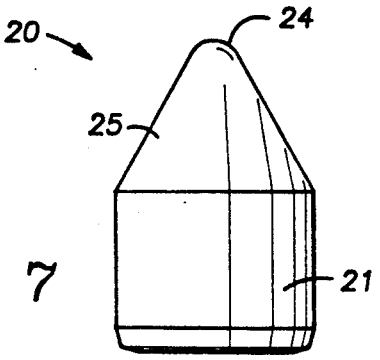
FIG. 7 is a side elevational view of the first embodiment.
Figure 8:
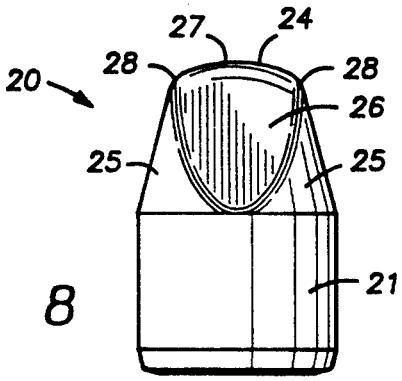
FIG. 8 is a front elevational view of the first embodiment.

FIGS. 5 through 8 illustrate schematically the insert made in accordance with the present invention. The insert, generally indicated by arrow 20 includes a cylindrical base 21. This base construction is conventional in nature and is similar to the base construction 12 of the prior art insert shown in FIGS. 1 through 4.

The novel construction lies in the cutting tip portion 22. This construction comprises a circular base 23 formed at its lower end while the upper end terminates with a crest 24. The crest 24 is characterized by the fact that the crest 24 is rounded with respect to its median line rather than being flat or parallel with the median line. (See FIG. 8).

The cutting tip 22 also has a pair of flanks 26 generally converging toward crest 24 with the balance of the cutting tip 22 being a conical surface 25.

The crest 24, the flanks 26 and the conical surfaces 25 intersect in such a manner that the crest 24 forms a "dog bone" configuration, i.e. a non-uniform width, thin at the middle and flaring out to a larger dimension at each end.

The crest 24 is rounded or radiused along and athwart the median line to blend in with the flanks 26 and the conical surfaces 25. The radius forming the crest is smallest at the middle at 27 and becomes larger as it reaches the ends at 28. This varying crest or nose area allows the higher loaded areas on the outside corners of the crest to have the larger mass to counteract such loads.

Moreover, since the crest 24 is also convex along its median line, the actual insert extension is less at the crest corners thereby making a shorter moment arm in a location where impacts are more frequent.

Figure 9:
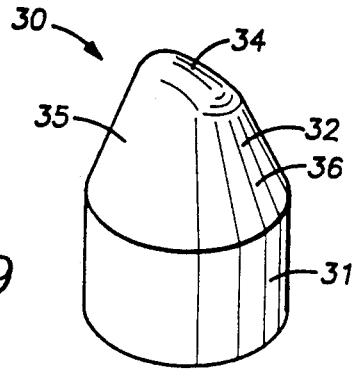
FIG. 9 is a perspective view of the second embodiment of the present invention.
Figure 10:
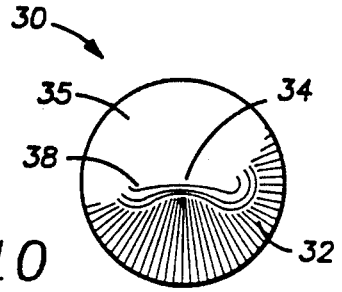
FIG. 10 is a top elevational view of the second embodiment.
Figure 11:
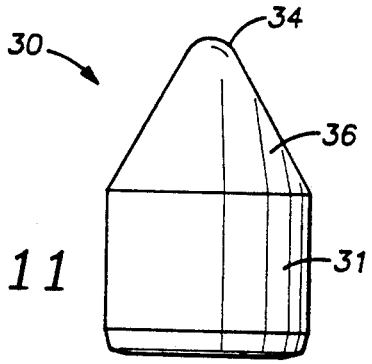
FIG. 11 is a side elevational view of the second embodiment.
Figure 12:
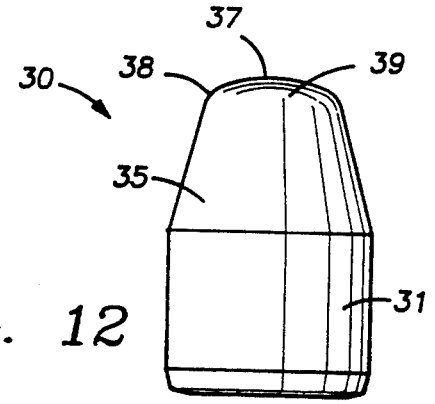
FIG. 12 is a front elevational view of the second embodiment.

FIGS. 9 through 12 illustrate a second embodiment of the present invention. This embodiment is similar to the first embodiment except that the flanks are not utilized and the areas between the conical surfaces are substantially convex.

This embodiment includes a tungsten carbide insert, indicated by arrow 30, having a base section 31 and a cutting tip section 32. The nose or top portion of the cutting tip 32 forms a crest 34 which is convex with respect to its median line and rounded or radiused along its length thereof and at its ends.

The rest of the cutting tip section 32 is formed by convex surfaces 36 extending from the ends of the crest 34 to the base section 31.

The area 36 between the convex surfaces 35, forming the remainder of the cutting tip section 32, is substantially convex as it extends from the base section 31 and approaches the crest 34.

The crest 34 of the second embodiment is similar to that shown in the first embodiment in that it is shaped like a "dog bone", i.e. a non-uniform width, thin at the middle and flaring out to a larger dimension at each end. The crest 34 is rounded or radiused athwart the median line with the radius being smaller at the middle at 37 and becoming larger as it reaches the ends at 38.

The portions 39 of the areas 35 just below the crest 34 are slightly convex in order to intersect with the "dog boned" crest 34. The convex areas 36 transition with the convex surfaces 35. As a result, the cutting tip section 32 has no non-tangential intersections between the various surfaces to avoid any high stress areas thereon.

It will of course be realized that various modifications can be made in the design and operation of the present invention without departing from the spirit thereon. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A shaped insert for a rolling cone rock bit having a base section and a cutting tip section, said base section being generally cylindrical and is adapted to extend into a matching hole formed in the bit cone, the longitudinal axis of the base forming the axis of the insert, the upper end of the cutting tip section, furthest away from the base section, comprises an elongated crest having a median line substantially normal to the insert axis, the crest being radiused along and normal to the median line and at its ends with the radius forming the crest is smallest at the middle and becoming larger as it reaches the ends, thereby enabling the ends of the crest to have a larger mass than the middle to better absorb the higher loads acting on the outside corners of the crest.

2. The invention of claim 1 wherein the insert is made of tungsten carbide.

3. The invention of claim 1 wherein the crest is convex upwardly with respect to the median line whereby the actual insert extension is less at the corners thereby making a shorter moment arm at a location where impacts are more frequent.

4. The invention of claim 1 wherein the cutting tip section further includes a convex surface extending under and blending with each end of the crest and a flank on each side of the crest between the convex surfaces, said flanks blending with the sides of the crest in such a manner to enable the crest to maintain its enlarged radius at its ends.

5. The invention of claim 3 wherein the cutting tip section further includes a convex surface extending under and blending with each end of the crest and a flank on each side of the crest between the convex surfaces, said flanks blending with the sides of the crest in such a manner to enable the crest to maintain its enlarged radius at its ends.

6. The invention of claim 4 wherein the flanks are convex outwardly to blend with the convex surfaces having no non-tangential intersections therewith.

7. The invention of claim 5 wherein the flanks are convex outwardly to blend with the convex surfaces having no non-tangential intersections therewith.

8. The invention of claim 1 wherein the cutting tip section further comprises a convex surface between the crest and the base having no non-tangential intersections.

9. The invention of claim 3 wherein the cutting tip section further comprises a convex surface between the crest and the base having no non-tangential intersections.

* * * * *